US005243965A

United States Patent [19]

Maitland et al.

[11] Patent Number: 5,243,965

[45] Date of Patent: Sep. 14, 1993

[54] HEAT PRODUCING GAS LOG APPARATUS

[75] Inventors: Kenneth R. Maitland, Huntington; Thomas J. Beal, Ossian; Roy E. Mundy, Roann, all of Ind.

[73] Assignee: Majco Building Specialties, L.P., Huntington, Ind.

[21] Appl. No.: 900,237

[22] Filed: Jun. 17, 1992

Related U.S. Application Data

[63] Continuation-in-part of Ser. No. 746,280, Aug. 16, 1991, abandoned.

[51] Int. Cl.[5] ..... F24C 73/00

[52] U.S. Cl. ..... 126/512; 126/89; 126/92 R

[58] Field of Search ..... 126/512, 503, 89, 92 R

[56] References Cited

U.S. PATENT DOCUMENTS

| | | | |
|---|---|---|---|
| 3,240,206 | 3/1966 | Schutt | 126/121 |
| 4,291,670 | 9/1981 | Hyatt | 126/121 |
| 4,480,594 | 10/1983 | Shimek et al. | 126/121 |
| 4,512,329 | 4/1985 | Sweet | 126/135 |
| 4,694,818 | 9/1987 | Bridgwater | 126/127 |
| 4,793,322 | 12/1988 | Shimek et al. | 126/80 |
| 4,875,464 | 10/1989 | Shimek et al. | 126/92 |
| 5,000,162 | 3/1991 | Shimek et al. | 126/512 |
| 5,054,468 | 10/1991 | Moon et al. | 126/512 |

FOREIGN PATENT DOCUMENTS 1239314 7/1988 Canada .

*Primary Examiner*—Carroll B. Dority
*Attorney, Agent, or Firm*—Baker & Daniels

[57] ABSTRACT

A heat producing gas log apparatus includes a blower having an inlet and an outlet for circulating air through the log apparatus. A gas burner has a plurality of openings for emitting combustible gas to produce a flame. At least one air supply channel has an inlet opening and an outlet opening. The inlet opening is disposed at the front and bottom of the heat producing gas log apparatus and receives air, and the outlet opening is in fluid communication with the blower inlet. At least one heat exchanger tube is disposed above at least a portion of the gas burner and has an inlet end and an outlet end. The inlet end is in fluid communication with the blower outlet, and the outlet end is disposed generally coplanar with the inlet opening of the at least one air supply channel at the front and bottom of the apparatus.

23 Claims, 3 Drawing Sheets

HEAT PRODUCING GAS LOG APPARATUS

This is a continuation-in-part of application Ser. No. 07/746,280, filed Aug. 16, 1991 and now abandoned.

BACKGROUND OF THE INVENTION

1. Field of the Invention

This invention relates to a gas log apparatus and, more particularly, to a heat producing gas log apparatus which circulates air through heat exchanger tubes disposed above a gas burner for heating the air and exhausting the heated air into the environment.

2. Description of the Prior Art

It is known in the art to circulate cool ambient air from the environment through ducting disposed adjacent to an open flame and exhaust the air which is heated thereby back into the environment For example, U.S. Pat. No. 4,408,594 to Shimek, et al., discloses a hollow heated grate for a fireplace in which a blower circulates air through a plenum comprising a plurality of hollow tubes and exhausts the heated air back into the environment.

Air circulating systems have also been employed in gas log burners. U.S. Pat. No. 5,000,162 to Shimek, et al., discloses a heating system for a gas log apparatus wherein air enters at one side of the system, passes through ductwork formed under the gas flame and into the ambient environment at the other side of the system. As with U.S. Pat. No. 4,408,594, the air circulates through the ductwork disposed underneath the gas flame with a resultant relatively poor heat transfer rate therebetween.

It is also known in the art to heat air flowing through a conduit which is disposed above a gas flame. U.S. Pat. No. 4,291,670 to Hyatt and Canadian Patent No. 1,239,314 to Martin both disclose a heat exchanger having a plurality of formed hollow cylindrical tubes disposed above an open flame source. Air enters the plurality of tubes near the bottom of the apparatus and is circulated through the plurality of tubes above the open flame source. The air flowing through the tubes is heated by the open flame source and is exhausted from the outlet of the tubes near the top of the apparatus. The Hyatt and Martin heat exchangers were a step forward in the art but have a relatively high dimensional profile.

What is needed is a heat exchanger integrated with a gas log apparatus which has a relatively low dimensional profile, and which further has an output temperature from the heat exchanger which is higher than heretofore possible with the prior art.

SUMMARY OF THE INVENTION

The present invention provides a heat producing gas log apparatus wherein a plurality of heat exchanger tubes are heated by a standard gas burner and have outlets thereof in a plane generally coincident with at least one air supply channel, thereby resulting in an apparatus having a relatively low dimensional profile. The plurality of heat exchanger tubes are disposed adjacent to the air supply channel such that a portion of the heated exhaust air is recirculated through the heat exchanger tubes, thereby increasing the output temperature of the exhaust air.

Accordingly, the invention comprises, in one form thereof, a heat producing gas log apparatus including a blower having an inlet and an outlet for circulating air through the log apparatus. A gas burner has a plurality of openings for emitting combustible gas to produce a flame. At least one air supply channel has an inlet opening and an outlet opening. The inlet opening is disposed at the front and bottom of the heat producing gas log apparatus and receives air, and the outlet opening is in fluid communication with the blower inlet. At least one heat exchanger tube is disposed above at least a portion of the gas burner and has an inlet end and an outlet end. The inlet end is in fluid communication with the blower outlet, and the outlet end is disposed generally coplanar with the inlet opening of the at least one air supply channel at the front and bottom of the apparatus.

In a preferred embodiment of the invention, the gas burner is formed in a U-shape having a rear leg portion and a front leg portion, and the heat exchanger tube is formed to be disposed above the rear leg portion and below the front leg portion.

In yet another embodiment of the invention, a portion of the heated air exhausted from the outlet end of the heat exchanger tube is recirculated to increase the exhaust air temperature from the heat exchanger tube.

An advantage of the present invention is that the inlet opening of at least one air supply channel and the outlet end of at least one of the heat exchanger tubes are disposed in a generally horizontal coplanar relationship to each other at the front and bottom of the apparatus, thereby providing heat exchange with a low dimensional profile.

Another advantage is that a portion of the heated exhaust air is recirculated through the apparatus, thereby resulting in an increased exhaust temperature.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates a preferred embodiment of the invention and such exemplification is not to be construed as limiting the scope of the invention in any manner.

DETAILED DESCRIPTION OF THE INVENTION

Figure 1:
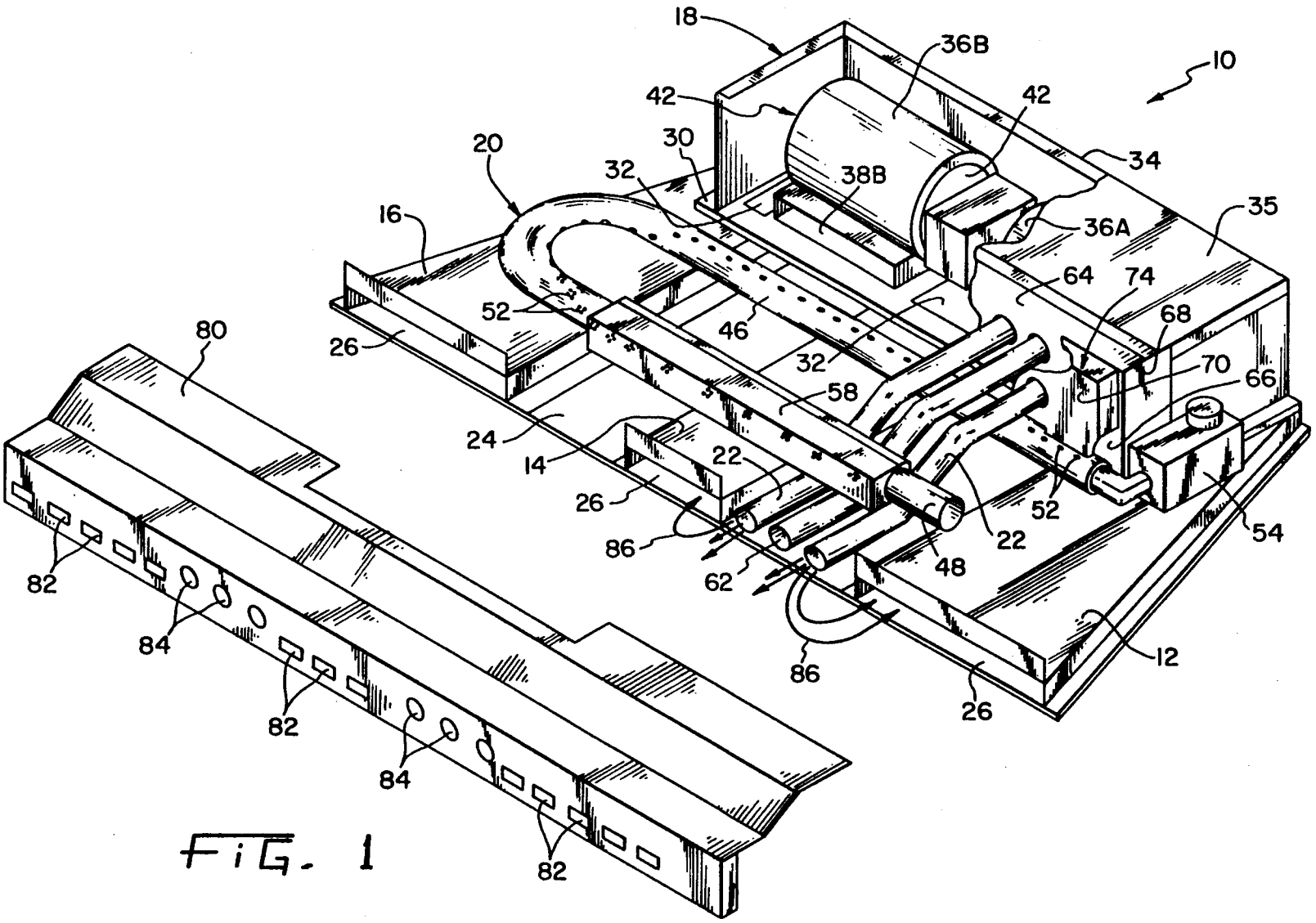
FIG. 1 is a partially exploded, perspective view of one embodiment of the gas log apparatus of the present invention wherein the logs have been removed to better show the details of the heat exchanger.
Figure 2:
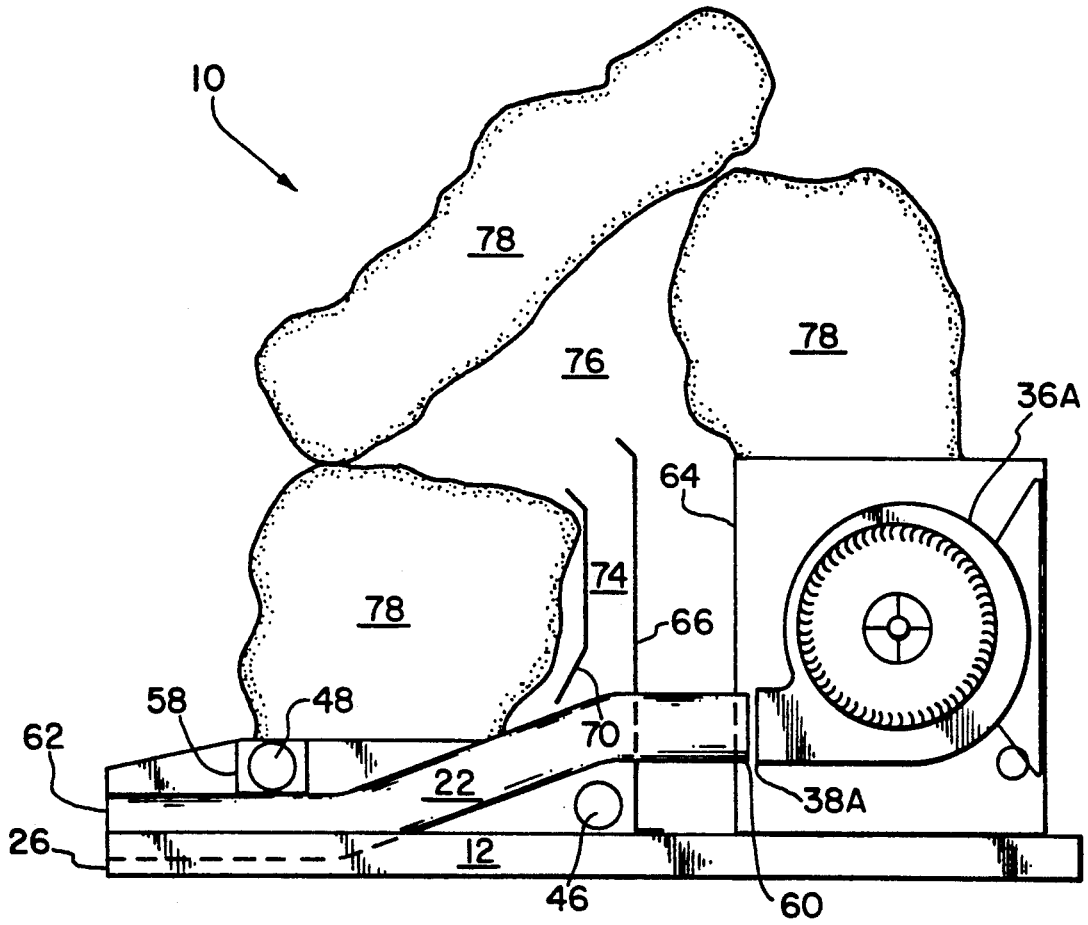
FIG. 2 is a sectional side view of the embodiment shown in FIG. 1.
Figure 3:
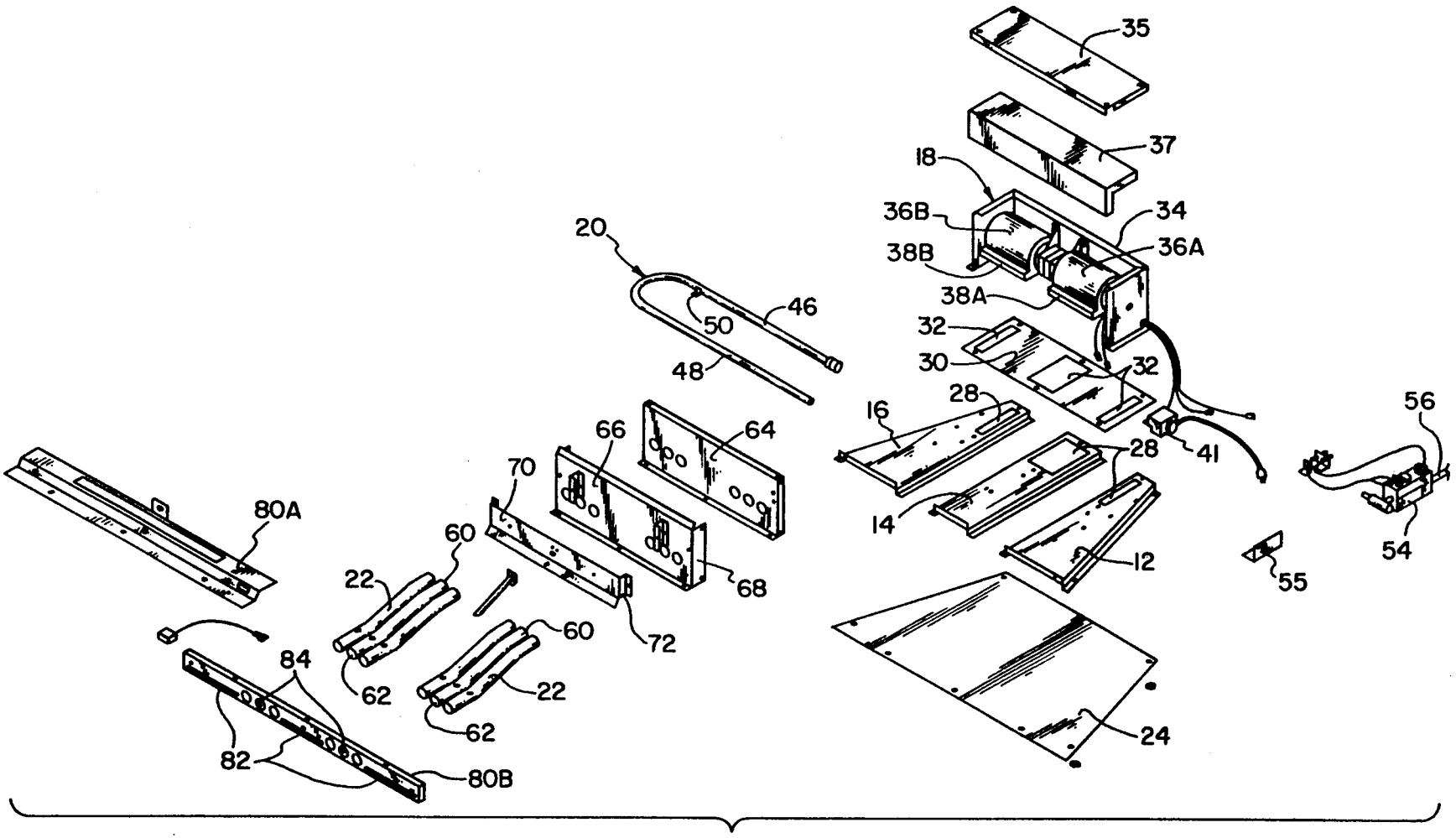
FIG. 3 is an exploded view of the embodiment shown in FIG. 1.

Referring now to the drawings, and particularly to FIGS. 1–3, there is shown one embodiment of the present invention. A heat producing gas log apparatus 10 generally includes air intake channels 12, 14 and 16, blower assembly 18, gas burner 20 and heat exchanger tubes 22.

The term "low dimensional profile", as used in this application, means the apparent height of the apparatus as viewed from the front of the heat producing gas log apparatus. In contrast with the prior art, the heat exchanger tubes and at least one air supply channel of the present invention lie in a generally coplanar relationship to each other at the bottom of the apparatus. Because the blower assembly 18 is disposed behind the concrete logs 78 and is not visible to a user, the apparent height of the apparatus is the height of front trim strip 80. The present invention accordingly provides greater aesthetic appeal by reducing the dimensional profile of the apparatus which is apparent to a user.

More particularly, gas log apparatus 10 includes a base plate 24 to which are mounted air supply channels 12, 14 and 16, each air supply channel 12, 14 and 16 having an inlet opening 26 disposed at the front of gas log apparatus 10 and an outlet opening 28 (FIG. 3) disposed at the rear of gas log apparatus 10. Air supply channel 14 is centrally positioned within gas log apparatus 10 and outside air supply channels 12 and 16 are spaced laterally therefrom adjacent to the sides of gas log apparatus 10.

Blower assembly 18 is mounted rearwardly on apparatus 10 and comprises a bottom plate 30 mounted to the rear portions of air supply channels 12, 14 and 16 and having three air intake openings 32 (FIG. 3; only two of which are visible in FIG. 1) communicating with the interior of blower housing 34. A pair of centrifugal blowers 36A and 36B having outlets 38A and 38B are mounted within housing 34 and are driven by a motor 40. A flanged lid 35 covers the top of housing 34. Centrifugal blowers 36A and 36B may be of conventional design having at least one inlet 42 which draws air axially inward into blowers 36A and 36B and exhausts air radially outward through outlets 38A and 38B. Centrifugal blowers 36A and 36B may be fastened to the rearward surface of housing 34 by any conventional means (FIGS. 2 and 3). Motor 40 is preferably an electrical motor having a rotational speed sufficient to produce a desired exhaust air flow rate from heat exchanger tubes 22. An electrical switch 41, which may be a rheostat type electrical switch, is provided to control the operation of motor 40.

A standard gas burner 20 is formed in a U-shape and includes a rear leg portion 46 and a front leg portion 48. Gas burner 20 is disposed above air supply channels 12, 14 and 16 and may be rigidly secured to the upper surfaces of air supply channels 12, 14 and 16 by, e.g., support brackets 50 (FIG. 3) and screws. Gas burner 20 includes a plurality of openings 52 (FIG. 1) through which combustible gas is emitted to form tall, decorative flames from rear leg portion 46, as well as short, propagation flames from front leg portion 48, in a manner that is well known in the art.

A standard Robertshaw gas supply valve 54 is connected to the rear leg portion 46 of gas burner 20 on the output side thereof and is connected to a gas supply line 56, such as, e.g., shown in FIG. 3, on the input side thereof. Gas supply valve 54 may be fastened to a bracket 55 (FIG. 3) which in turn is fastened to base plat 24 by any conventional means, e.g., by welding or sheet metal screws.

Front leg portion 48 of gas burner 20 may extend through a tray 58 (FIGS. 1 and 2) which is open on top and filled with sand or vermiculite. Openings 52 formed in front leg portion 48 of gas burner 20 face downwardly, thereby causing the gas emitted therefrom to be diffused through the sand or vermiculite. Mineral wool (not shown) may be provided and disposed above and in front of tray 58. The burning, diffused gas causes the mineral wool to glow and simulates glowing embers.

Heat exchanger tubes 22 are hollow tubes formed to extend above the rear leg portion 46 of gas burner 20 and below the front leg portion 48 of gas burner 20. Inlet end 60 of each heat exchanger tube 22 is in fluid communication with centrifugal blower 36A or 36B and is positioned in alignment with and slightly spaced from blower outlets 38A or 38B (FIG. 2). Outlet end 62 of each heat exchanger tube 22 is in fluid communication with the ambient environment and is disposed at the front of gas log apparatus 10. In the embodiment shown in FIGS. 1-3, outlet ends 62 of heat exchanger tubes 22 and inlet openings 26 of air supply channels 12, 14 and 16 are interleaved and lie in a generally horizontal common plane at and terminate at the front and bottom of gas log apparatus 10. Heat exchanger tubes 22 may be welded or otherwise fixed to front plate 64 of blower housing 34; and may also be fixed by conventional means to the base plate 24.

In the perspective view of FIG. 1, heat producing gas log apparatus 10 is shown, for purposes of brevity, with three heat exchanger tubes 22 disposed between air supply channels 12 and 14. As shown in FIG. 3, however, three similarly formed heat exchanger tubes are provided which are disposed between air supply channels 14 and 16 and which are in fluid communication with blower 36B. Thus, in the embodiment shown in FIGS. 1-3, heat producing gas log apparatus 10 is provided with six heat exchanger tubes 22.

A heat shield 66, including side panels 68, is spaced forwardly of the front wall 64 of blower housing 34 and reduces heat transfer between the flames emitted from gas burner 20 and the interior of blower housing 34. Reducing the heat transfer into blower housing 34, and thereby reducing the operating temperature within blower housing 34, may be necessary to prevent overheating and possible damage to motor 40. To further reduce heat transfer into the interior of blower housing 34, insulation 37 (FIG. 3) may be provided on the interior of blower housing 34 at the forward and upper surfaces thereof.

A flame guide 70 is fixed to heat shield 66 via a side member 72 and is disposed generally parallel to and forward of heat shield 66. In the embodiment shown in FIGS. 1-3, heat shield 66 and side panels 68; and flame guide 70 and side members 72, are formed from a single piece of metal (FIG. 3) by, e.g., a bending operation. As may be seen in the drawings, side panels 68 and side members 72 are formed with holes therein for respective attachment via sheet metal screws to the front plate 64 and heat shield 66. Alternatively, side members 72 of flame guide 56 may be fastened to heat shield 66 by, e.g., welding.

Flame guide 70, heat shield 66 and side members 72 form a flame conduit 74 for directing the taller, decorative flames from rear leg portion 46 of gas burner 44 into a chamber 76 which may be formed between concrete logs 78. Flame guide 70 also ensures that the concrete log 78 disposed immediately above front leg portion 48 of gas burner 44 is maintained in a position forward of rear leg portion 46 such that the taller decorative flames may be emitted into chamber 76 and impinge on top log 78.

A plurality of concrete logs 78 (FIG. 2) may be supported by the blower housing 34 and heat exchanger tubes 22. Logs 78 are of the type known in the art.

A front trim strip 80 conceals the front of heat producing gas log apparatus 10 and is provided with a plurality of cut-out openings 82 (FIGS. 1 and 3) in register with inlet openings 26 of air supply channels 12, 14 and 16; and a plurality of cut-out openings 84 in register with outlet ends 62 of heat exchanger tubes 22. In the embodiment shown in FIG. 1, front trim strip 80 is formed from a single piece of metal. In another embodiment, as illustrated in FIG. 3, front trim strip 80 may be formed from two pieces of metal, i.e., a front piece 80B having cut-out openings 82 and 84 formed therein, and a top piece 80A.

During operation, as blowers 26 are driven by motor 40, air is drawn inwardly through cut-out openings 82 and inlet openings 26 and is drawn rearwardly through air supply channels 12, 14 and 16 to the respective air channel outlet openings 28. The air enters blower housing 34 of blower assembly 18 through the air intake openings 32 and flows axially into inlets 42 of blowers 36. Blowers 36 pressurize the air which then is exhausted through outlets 38A and 38 into the plurality of heat exchanger tubes 22. Heat exchanger tubes 22 are positioned above burner 36 such that the flames emitted through openings 52 of gas burner 44 directly contact heat exchanger tubes 22, resulting in heat transfer between the flames, the plurality of heat exchanger tubes 22 and the air flowing through the heat exchanger tubes 22, and thereby increasing the temperature of the air flowing through the heat exchanger tubes 22. The heated air flowing through heat exchanger tubes 22 flows outwardly from outlet ends 62 of heat exchanger tubes 22 through openings 84 of front trim strip 80 and heats the ambient environment.

As represented in FIG. 1 by air flow directional arrows 86, a portion of the heated air exhausted from the heat exchanger tubes 22 and openings 84 adjacent to the air supply channels 12, 14 and 16 is recirculated via cut-out openings 82 and air supply channels 12, 14 and 16 through heat producing gas log apparatus 10. More particularly, it may be seen from the drawings that at least some of the plurality of heat exchanger tubes 22 are disposed adjacent to the at least one air supply channel 10. A part of the heated exhaust air from heat exchanger tubes 22 is drawn into the intake opening 26 of air supply channels 12, 14 and 16 and mixes with cooler ambient air also drawn into air supply channels 12, 14 and 16. The average temperature of the air entering blower assembly 18 is therefore higher than the cooler ambient air from the environment, with a resultant increased output exhaust temperature from heat exchanger tubes 22. Thus, recirculating a portion of the heated exhaust air through the heat producing gas log apparatus 10 results in a higher output exhaust temperature from the plurality of heat exchanger tubes 22.

By interleaving air supply channels 12, 14 and 16 with heat exchanger tubes 22, a balanced air intake and output is achieved. Moreover, a portion of the heated air exhausted from outlet ends 62 of heat exchanger tubes 22 is recirculated through air channel inlet openings 26 and through heat producing gas log apparatus 10, resulting in an increased exhaust temperature from outlet ends 62 of heat exchanger tubes 22. Furthermore, the front of the heat producing gas log apparatus 10 has a low dimensional profile providing greater aesthetic appeal.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heat producing gas log apparatus having a front that faces forwardly, comprising:

a substantially horizontally extending gas burner having a plurality of openings for emitting combustible gas to produce a flame;

a blower having an inlet and an outlet for circulating air through the apparatus;

at least one air supply channel having an inlet opening and an outlet opening, said inlet opening disposed in a low position at the front of the gas log apparatus for receiving intake air, said outlet opening being in fluid communication with said blower inlet;

at least one heat exchanger tube disposed above at least a portion of said gas burner and having an inlet end and an outlet end, said inlet end being in fluid communication with said blower outlet, said outlet end disposed generally coplanar with the inlet opening of the air supply channel at the front of the heat producing gas log apparatus.

2. The heat producing gas log apparatus of claim 1 wherein said gas burner is formed in a U-shape having a rear leg portion and a front leg portion, and said heat exchanger tube is formed to be disposed above said rear leg portion and below said front leg portion.

3. The heat producing gas log apparatus of claim 2 comprising a plurality of said heat exchanger tubes, wherein said tubes are formed into an offset shape wherein the rear portion and front portion of each are generally horizontal and are connected by an angled transition portion.

4. The heat producing gas log apparatus of claim 2 wherein said openings formed in the front leg portion face downward, and further comprising a tray surrounding at least part of said front leg portion and having therein a granular substance.

5. The heat producing gas log apparatus of claim 4 further comprising mineral wool disposed at the forward and exterior surface of said tray.

6. The heat producing gas log apparatus of claim 1 wherein the heat exchanger outlet and the air supply channel inlet are in close proximity to each other so that a portion of the heated air exhausted from said outlet end of said heat exchanger tube is recirculated through said air supply channel to increase the exhaust air temperature from said heat exchanger tube.

7. The heat producing gas log apparatus of claim 1 further comprising a valve for controlling the flow of gas flowing through said gas burner.

8. The heat producing gas log apparatus of claim 1 further comprising a variable control switch connected to said blower for controlling the air flow rate through the heat exchanger.

9. The heat producing gas log apparatus of claim 1 wherein two said blowers are provided and further comprising a common motor between said blowers for simultaneously driving said blowers.

10. The heat producing gas log apparatus of claim 9 further comprising a blower assembly, said blower assembly comprising said two blowers and motor, and a blower housing for housing said two blowers and motor, said motor rigidly affixed to said blower housing, said blower housing formed with at least one air intake opening in fluid communication with said outlet opening of said air supply channel for supplying air to said two blowers, and a front plate adapted to receive said heat exchanger tube.

11. The heat producing gas log apparatus of claim 10 further comprising a heat shield disposed between said blower housing and said gas burner for reducing the heat transfer therebetween.

12. The heat producing gas log apparatus of claim 11 further comprising a flame guide disposed forward of a rear portion of said gas burner, said flame guide and said heat shield defining a flame conduit through which taller, decorative flames may be emitted from said rear portion of said gas burner.

13. The heat producing gas log apparatus of claim 12 wherein said flame guide is affixed to said heat shield.

14. The heat producing gas log apparatus of claim 1 further comprising a trim strip for decoratively covering said air supply channel inlet opening of said air supply channel and said outlet end of said heat exchanger tube.

15. The heat producing gas log apparatus of claim 1 comprising three said air supply channels for supplying air to said blower, and comprising two sets of three said heat exchanger tubes, one set of three heat exchanger tubes in fluid communication with the outlet of one of said two blowers, and the other set of three heat exchanger tubes in fluid communication with the outlet of the other of said two blowers, said three air supply channels and said two sets of heat exchanger tubes disposed in an interleaved arrangement wherein a set of said heat exchanger tubes is disposed between adjacent air supply channels.

16. The heat producing gas log apparatus of claim 1 comprising a plurality of said air supply channels spaced apart across the front of the apparatus and a plurality of heat exchanger tubes spaced apart across the front of the apparatus, at least one of said heat exchanger tubes being disposed intermediate two of said air supply channels.

17. The heat producing gas log apparatus of claim 16 wherein at least one of said air supply channels is disposed intermediate two of said heat exchanger tubes.

18. A heat producing gas log apparatus, comprising:

a horizontally extending gas burner having a plurality of openings for emitting combustible gas to produce a flame;

a blower having an inlet and an outlet for circulating air through the heat producing gas log apparatus;

at least one air supply channel having an inlet opening and an outlet opening, said inlet opening disposed in a low position at a front side of the heat producing gas log apparatus and receiving air, said outlet opening in fluid communication with said blower inlet;

at least one heat exchanger tube disposed above at least a portion of said gas burner and having an inlet end and an outlet end, said inlet end in fluid communication with said blower outlet, said outlet end disposed adjacent said inlet opening of said air supply channel such that a portion of the heated air exhausted from said outlet end of said heat exchanger tube is recirculated through said heat producing gas log apparatus to increase the exhaust air temperature from said heat exchanger tube.

19. The heat producing gas log apparatus of claim 18 wherein the inlet opening of said air supply channel and the outlet end of said heat exchanger tube are disposed in a generally horizontal coplanar relationship to each other at the front of the heat producing gas log apparatus.

20. The heat producing gas log apparatus of claim 18 wherein said gas burner is formed in a U-shape having a rear leg portion and a front leg portion, said at least one heat exchanger tube formed to be disposed above said rear leg portion and below said front leg portion.

21. The heat producing gas log apparatus of claim 18 wherein two centrifugal blowers are provided and further comprising a common motor between said two centrifugal blowers for simultaneously driving said two centrifugal blowers.

22. The heat producing gas log apparatus of claim 21 comprising three said air supply channels for supplying air to said two blowers, and comprising two sets of said heat exchanger tubes, one set of heat exchanger tubes in fluid communication with the outlet of one of said two blowers, and the other set of heat exchanger tubes in fluid communication with the outlet of the other of said two blowers, said three air supply channels and said two sets of heat exchanger tubes disposed in an interleaved arrangement.

23. A heat producing gas log apparatus, comprising:

a blower having an inlet and an outlet for circulating air through the heat producing gas log apparatus;

a gas burner having a plurality of openings for emitting combustible gas to produce a flame;

at least one air supply channel having an inlet opening and an outlet opening, said inlet opening disposed in a low position at a front of the heat producing gas log apparatus and receiving air, said outlet opening in fluid communication with said blower inlet;

at least one heat exchanger tube disposed above at least a portion of said gas burner and having an inlet end and an outlet end, said inlet end in fluid communication with said blower outlet, said outlet end disposed generally coplanar with the inlet opening of the air supply channel at the front of the heat producing gas log apparatus, and adjacent said inlet opening of said air supply channel such that a portion of the heated air exhausted from said outlet end of said at least one heat exchanger tube is recirculated through said heat producing gas log apparatus to increase the exhaust air temperature from said heat exchanger tube.

* * * * *